US009453701B2

(12) United States Patent
Simek

(10) Patent No.: US 9,453,701 B2
(45) Date of Patent: Sep. 27, 2016

(54) CONNECTING MECHANISM FOR CONNECTION OF THE FIREARM RECEIVER AND THE SHOULDER MOUNT

(71) Applicant: CESKA ZBROJOVKA A.S., Uhersky Brod (CZ)

(72) Inventor: Vladimir Simek, Lostice (CZ)

(73) Assignee: CESKA ZBROJOVKA A.S (CZ)

( * ) Notice: Subject to any disclaimer, the term of this patent is extended or adjusted under 35 U.S.C. 154(b) by 0 days.

(21) Appl. No.: 14/398,932

(22) PCT Filed: Apr. 29, 2013

(86) PCT No.: PCT/CZ2013/000059
§ 371 (c)(1),
(2) Date: Nov. 4, 2014

(87) PCT Pub. No.: WO2013/163967
PCT Pub. Date: Nov. 7, 2013

(65) Prior Publication Data

US 2015/0176945 A1 Jun. 25, 2015

(30) Foreign Application Priority Data

May 4, 2012 (CZ) ..... 2012-298

(51) Int. Cl.
*F41A 11/04* (2006.01)
*F41C 23/14* (2006.01)
*F41A 3/64* (2006.01)
(Continued)

(52) U.S. Cl.
CPC ..... *F41C 23/14* (2013.01); *F41A 3/64* (2013.01); *F41A 3/66* (2013.01); *F41A 11/04* (2013.01); *F41C 23/04* (2013.01); *F41C 23/20* (2013.01)

(58) Field of Classification Search
CPC ..... F41C 23/04; F41C 23/14; F41C 23/16; F41C 23/20; F41A 3/64; F41A 3/66; F41A 11/02; F41A 11/04
USPC ..... 42/75.03, 75.1, 75.01, 73, 72, 71.01
See application file for complete search history.

(56) References Cited

U.S. PATENT DOCUMENTS 4,788,785 A * 12/1988 White ..... F41C 23/04 42/72
6,901,691 B1 * 6/2005 Little ..... F41A 23/02 42/118

(Continued)

FOREIGN PATENT DOCUMENTS

EP 2045560 A2 4/2009

OTHER PUBLICATIONS

International Search Report in corresponding International Application PCT/CZ2013/000059 (2 pages).

*Primary Examiner* — John D Cooper
(74) *Attorney, Agent, or Firm* — Hovey Williams LLP

(57) ABSTRACT

A connection mechanism for connection of a firearm receiver and a shoulder mount, the fire arm receiver comprising a closing part, the closing part containing a latch arranged in a movable way between a locking position, in which in an assembled firearm the latch engages with the receiver and the closing part is prevented from being removed from the receiver, and an unlocking position, in which the latch disengages from the receiver and the closing part can be removed from the receiver. The closing part further contains a lever to control the movement of the latch from the locking position to the unlocking position and/or from the unlocking position to the locking position.

11 Claims, 3 Drawing Sheets

(51) Int. Cl.

| | |
|---|---|
| ***F41A 3/66*** | (2006.01) |
| ***F41C 23/04*** | (2006.01) |
| ***F41C 23/20*** | (2006.01) |

(56) References Cited

U.S. PATENT DOCUMENTS

| | | | | |
|---|---|---|---|---|
| 7,162,823 | B2 * | 1/2007 | Schoppman | F41A 11/04 42/75.01 |
| 7,966,761 | B1 * | 6/2011 | Kuczynko | F41C 23/04 42/73 |
| 7,966,762 | B2 * | 6/2011 | Barrett | F41A 19/13 42/75.01 |
| 8,720,099 | B1 * | 5/2014 | Sisk | F41C 23/14 42/73 |
| 2008/0005951 | A1 * | 1/2008 | Gorzen | F41A 3/10 42/14 |
| 2010/0132240 | A1 * | 6/2010 | Webber | F41A 11/02 42/75.03 |
| 2011/0099874 | A1 * | 5/2011 | Zedrosser | F41A 3/66 42/73 |
| 2011/0107644 | A1 * | 5/2011 | Faifer | F41C 23/04 42/75.02 |
| 2012/0137561 | A1 * | 6/2012 | Ludlow | F41C 23/04 42/75.03 |
| 2012/0137562 | A1 * | 6/2012 | Langevin | F41C 23/04 42/75.03 |
| 2012/0144712 | A1 * | 6/2012 | Rostocil | F41A 9/79 42/16 |
| 2013/0212920 | A1 * | 8/2013 | Law | F41C 23/14 42/75.03 |

* cited by examiner

CONNECTING MECHANISM FOR CONNECTION OF THE FIREARM RECEIVER AND THE SHOULDER MOUNT

This is a national stage application under 35 U.S.C. §371 of International Application PCT/CZ2013/000059 filed 29 Apr. 2013, which claims the benefit of Czech Republic application Ser. No. PV 2012-298 filed 04 May 2012, the entire disclosures of which are incorporated herein by reference.

FIELD OF THE INVENTION

The invention deals with a connection mechanism for connection of the firearm receiver and the shoulder mount.

STATE OF THE ART

In existing firearms dismountable pins of various designs are generally used to secure the connection of the receiver and the shoulder mount. A consequence of these designs is quite inconvenient connecting and disconnecting of the receiver and the shoulder mount. In some other designs the shoulder mount is firmly connected to the body of the trigger mechanism.

In more up-to-date designs a dismounting button that connects the shoulder mount and the closing part of the receiver is used to secure the connection; a spring then acts upon the dismounting button against the shooting direction. What is important in these designs is securing the dismounting button in the firearm to prevent spontaneous unlocking of the connection under impact stress of the firearm, which is problematic with regard to the direction of unlocking of the button. This means that these more modern designs also manifest some disadvantages.

SUMMARY OF THE INVENTION

The disadvantages of the hitherto state of the art are eliminated by a connecting mechanism for the connection of the firearm receiver and the shoulder mount in accordance with this invention, the connecting mechanism comprising a closing part of the receiver adapted for connection to the shoulder mount, wherein the closing part includes a latch arranged in a movable way between the locking position, in which in an assembled firearm the latch engages with the receiver and the closing part is secured against being removed from the receiver, and the unlocking position, in which the closing part can be removed from the receiver, its principle consisting in the fact that the closing part contains a lever to selectively control the latch movement from the locking position to the unlocking position and/or from the unlocking position to the locking position.

The connecting mechanism conveniently contains an elastic means acting upon the latch move it toward to the locking position and to maintain it in this position.

The connecting mechanism conveniently contains an elastic means acting upon the latch to remove it in the shooting direction to the locking position and to maintain it in this position.

The elastic means may be a wound compression spring.

In one of the embodiments of the present invention the connecting mechanism is arranged in such a way that if the shoulder mount is in the shooting position, the shoulder mount prevents the latch from moving to the unlocking position.

In one of the embodiments of the present invention, the elastic means acts upon the latch to move it in the shooting direction, and when the shoulder mount is removed or folded, the lever can be moved to put the latch in the unlocking position against the action of the elastic means. When the shoulder mount is in the shooting position, the shoulder mounts prevents the above mentioned lever movement and thus the resultant movement of the latch to the unlocking position. It is also in accordance with an embodiment of the present invention that the closing part of the firearm receiver contains a pin for rotary connection of the firearm receiver to the folding shoulder mount. Further, the elastic means can be a compression spring. In addition, the lever can be rotatably mounted to the closing part by a lever pin, wherein the top end of the lever is designed for manual control of the lever and the bottom end of the lever is connected to or on communication with the latch. In this configuration, when the shoulder mount is removed or folded, the latch can be moved against the force of the compression spring into the unlocking position by pushing the top end of the lever in the shooting direction, and when the shoulder mount is in the shooting position, the front face of the shoulder mount prevents the latch from moving into the unlocking position, thereby preventing unwanted separation of the shoulder mount from the receiver.

As indicated above, the mentioned disadvantage of problematic protection from unwanted pressing of the dismounting button under impact stress of the firearm, especially in the case of folding shoulder mounts, can be overcome through spring-loading of the latch of the closing part of the receiver (hereinafter also the "latch" only) in the shooting direction and its securing by the base of the shoulder mount, which in the raised and locked condition prevents compression of the latch and release of the connection of the closing part of the receiver and the firearm receiver. Thus, the connection is mechanically secured and to remove the closing part of the receiver the shoulder mount needs to be folded or removed first.

To achieve easier control of the latch the compression mechanism can be conveniently fitted with a "lever of the closing part latch" (hereinafter also the "lever") that can be rotated around a transversal axis. At a top end the lever is arranged in such a way to have a compression area while its bottom end leans against the latch or is connected to it. By selective compression of the top end control area, the lever bottom end which is connected to or in contact with the latch supplies a force which acts upon the latch and moves it against the compression spring and thereby against the shooting direction. On complete retraction of the latch, the closing part can be slid out of and removed from the firearm receiver.

What should be mentioned about the shoulder mount is that it is preferentially a folding shoulder mount that can be simple as well as telescopic. However, the shoulder mount does not necessarily have to be folding; it may be any suitable shoulder mount that can be dismounted or separated from the closing part of the firearm receiver if necessary. This disassembly or separating of the shoulder mount from the closing part makes it possible to move the latch from the locking position, in which the latch is adapted to be positioned and fit behind the interface that the rear end of the receiver is equipped with, to the unlocking position, in which the closing part can be slid out of the receiver. On the other hand, if the shoulder mount is in the shooting position, the latch cannot be moved, so unwanted (spontaneous) releasing of the closing part from the firearm receiver is prevented.

BRIEF DESCRIPTION OF THE DRAWINGS

The invention will be further clarified in a more detailed way using an example of its embodiment in connection with drawings in which.

EXAMPLES OF EMBODIMENTS OF THE INVENTION

Figure 1:
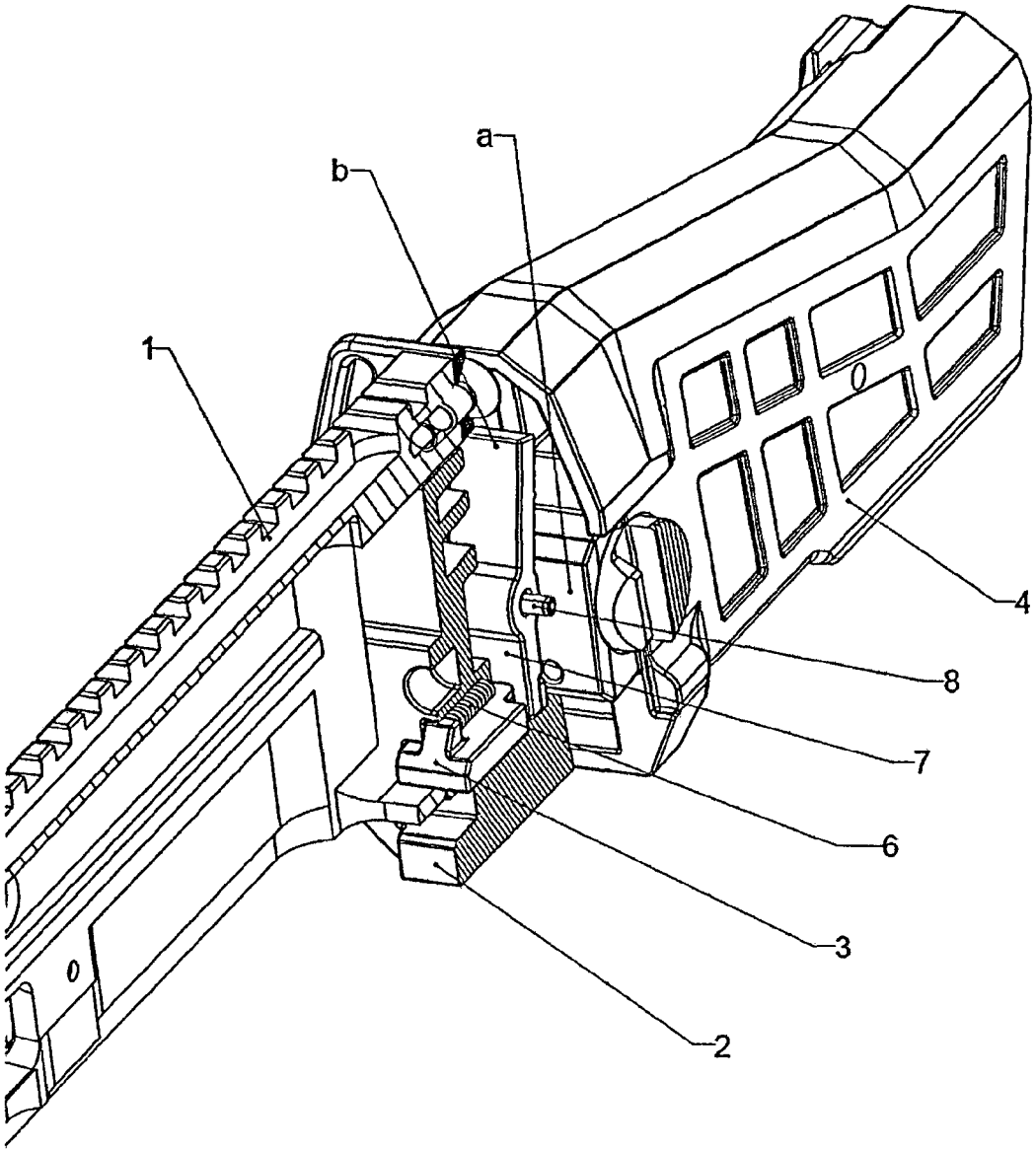
FIG. 1 is a perspective view of the connection mechanism of the present invention, with the firearm receiver shown in a fragmentary view, and further depicting the closing part of the firearm receiver in the locked position in a partially cross-sectional view.

As shown in the attached drawings, the receiver 1 of the firearm is connected to the closing part 2 of the receiver 1, the closing part 2 including a latch 3 fitting behind the fixed part of the receiver 1. The shoulder mount 4 can be selectively rotated around the pin 5 located in the closing part 2 of the receiver 1. The force of an elastic means such as a spring 6, or the like, acts upon the latch 3 to urge it or move it in the shooting direction of the firearm. The latch lever 7 has a top end b which is adapted to be selectively compressed toward the shooting direction or away from the shooting direction of the firearm receiver. Lever 7 has a bottom end which is adapted to be connected to or in contact with the latch 3, such as be friction contact or the like. Complete extension of the latch 3 is prevented by securing or contact of the latch 3 to the latch lever 7, the lever 7 being rotatably mounted to the closing part 2 by lever pin 8. When the shoulder mount 4 is in the shooting position, i.e. is not folded away or removed from the receiver 1, the front face a of the shoulder mount 4 is positioned adjacent the closing part 2 to thereby prevents the latch 3 from being pushed against the shooting direction, i.e. to the unlocking position.

Figure 3:
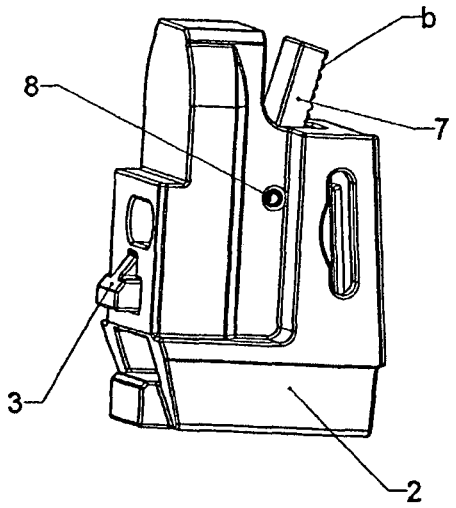
FIG. 3 is a front perspective view of the closing part of the receiver in one embodiment of the present invention.
Figure 4A:
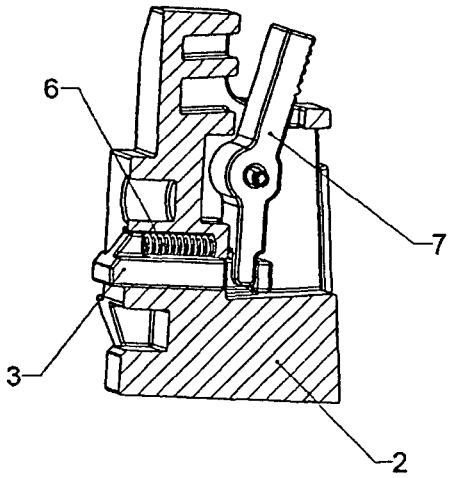
FIG. 4A is a vertical cross-sectional view of the closing part of the receiver of FIG. 3, depicting the latch in the locking configuration, i.e. in the configuration wherein the latch lever is not pressed in the shooting direction.

FIGS. 3 and 4A shows the closing part 2 in accordance with an embodiment of the present invention, depicting the latch 3 and the lever 7. In this embodiment, connection of the firearm receiver 1 and the shoulder mount 4 is designed in such a way that the bottom end of the lever 7 engages with the recess in the latch 3, the latch 3 being subjected to the action of a wound compression spring 6 and urged in the shooting direction.

Figure 4B:
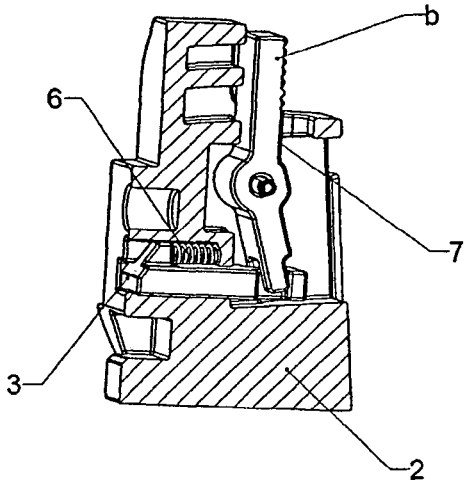
FIG. 4B is a vertical cross-sectional view of the closing part of the receiver of FIG. 3, depicting the latch in the unlocking configuration, i.e. in the configuration wherein the latch lever is pressed in the shooting direction.

As is evident from the drawings for FIGS. 1 and 4B. when the shoulder mount 4 is folded away or removed from the receiver 1, the top end b of the lever 7 can be selectively pushed in the shooting direction, the movement of the lever 7 acting against the force of the spring 6 by means of the bottom end of the lever 7 which is in connecting relationship with the latch 3, such that the movement of the lever 7 is transferred onto the latch 3. In this manner, the latch 3 can, be moved into the unlocking position, i.e. retracted into the closing part 2, and away from the engagement with the receiver 1. In this manner, removal of the closing part 2 out of the receiver 1 can be accomplished, as can be seen by the unlocking position depicted in FIG. 4B.

FIG. 3 shows the closing part 2 in a convenient embodiment of the design of the connection of the latch 3 with the lever 7. In the convenient embodiment this connection is designed in such a way that the bottom end of the lever 7 engages with the recess in the latch 3, the latch 3 being subjected to the action of a wound compression spring 6 in the shooting direction.

FIG. 4A is a cross-sectional representation of the latch 3 of the closing part 2 from FIG. 3 configured in the locking position, in which, as shown in FIG. 1 , the front face a of the shoulder mount 4 prevents retraction of the latch 3, i.e. prevents movement of the latch 3 from the locking position of FIG. 4A to the unlocking position as depicted in FIG. 4B. Thus, undesired release of the closing part 2 from the firearm receiver 1 is prevented.

Figure 2:
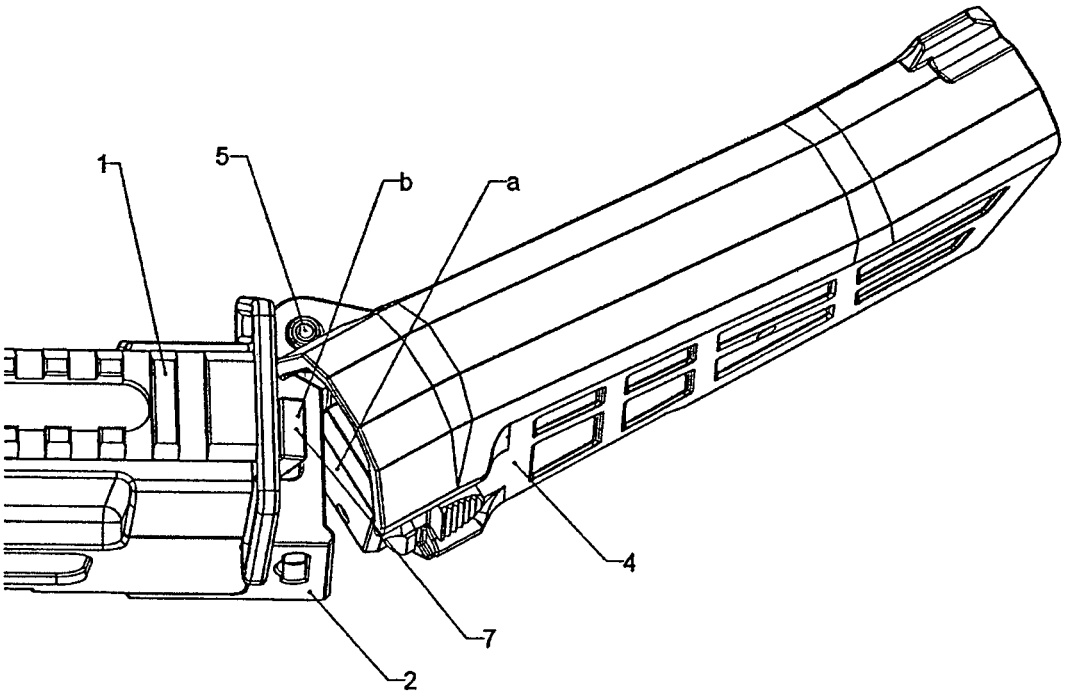
FIG. 2 is a perspective view of the connection mechanism of FIG. 1, depicting the shoulder mount in a folded or tilted configuration, in which the top end of the latch lever can be selectively pressed and the closing part of the firearm receiver can be selectively removed from the firearm receiver.

If it is desired that the closing part 2 be slid out of the firearm receiver 1 , the shoulder mount 4 must be folded away first as shown in FIG. 2, which will cause separation of the front face a of the shoulder mount 4 from the closing part 2, and which will allows the latch 3 to be moved against the pressure of the spring 6 from the locking position of FIG. 4A to the unlocking position of FIG. 4B. In this manner, the closing part 2 can be removed from the receiver 1, by pushing the top end b of the lever 7 to the unlocking position.

The invention has been described in a more detailed way using an embodiment example. However, the scope of the invention defined by the attached patent claims comprises a number of possible modifications or adaptations. For example, instead of a wound compression spring, another elastic means can be used such that the mutual mounting of the latch 3, elastic means and lever 7 can be designed in such a way that an elastic means is used that acts upon the latch 7 by tension instead of pressure. Further, the connection of the lever 7 and latch 3 can be designed differently as compared to the above mentioned embodiment example. The invention as described herein is not intended to be limited to the described embodiment example.

The invention claimed is:

1. A connection mechanism for the connection of a receiver of a firearm and a shoulder mount, the connection mechanism comprising a closing part adapted for releasably connecting with the receiver and for directly connecting with the shoulder mount and including a latch arranged in a movable way between a locking position, in which in an assembled firearm the latch engages with the receiver and the closing part is prevented from being removed from the receiver, and an unlocking position, in which the closing part can be removed from the receiver, characterized in that the closing part contains a lever to control the movement of the latch from the locking position to the unlocking position and/or from the unlocking position to the locking position; wherein when the shoulder mount is in an unfolded position, the shoulder mount prevents the latch from moving to the unlocking position.

2. The connection mechanism according to claim 1, wherein the connection mechanism further comprises an elastic spring acting upon the latch to move the latch to the locking position and to maintain it in this position.

3. The connection mechanism according to claim 2, wherein the elastic spring is a compression wound spring.

4. The connection mechanism according to claim 2, wherein when the shoulder mount is in an unfolded position, the shoulder mount prevents the latch from moving to the unlocking position.

5. The connection mechanism according to claim 2, wherein the elastic spring is adapted to act upon the latch to move it in a shooting direction, and further wherein when the shoulder mount is removed or folded away, selective movement of the lever is adapted to move the latch against the action of the elastic spring to the unlocking position, and when the shoulder mount is in an unfolded position, the shoulder mount prevents movement of the lever and the resultant movement of the latch to the unlocking position.

6. The connection mechanism according to claim 5, wherein:

the closing part contains a pin for rotary connection of the receiver of the firearm to the shoulder mount; the elastic spring is a compression spring; and the lever is rotatably mounted to the receiver by a lever pin, a top end of the lever being designed for manual control of the lever while a bottom end of the lever is connected to the latch, so that when the shoulder mount is removed or folded away, the latch can be selectively moved against the compression spring to the unlocking position by pushing the top end of the lever in the shooting direction, and when the shoulder mount is in the unfolded position, a front face of the shoulder mount prevents the latch from being moved to the unlocking position, thereby preventing unwanted separation of the shoulder mount from the receiver.

7. The connection mechanism according to claim 1, wherein the connection mechanism further comprises an elastic spring acting upon the latch to move the latch in a shooting direction to the locking position and to maintain it in this position.

8. The connection mechanism according to claim 7, wherein the elastic spring is a compression wound spring.

9. The connection mechanism according to claim 7, wherein when the shoulder mount is in an unfolded position, the shoulder mount prevents the latch from moving to the unlocking position.

10. The connection mechanism according to claim 7, wherein the elastic spring is adapted to act upon the latch to move it in a shooting direction, and further wherein when the shoulder mount is removed or folded away, selective movement of the lever is adapted to move the latch against the action of the elastic spring to the unlocking position, and when the shoulder mount is in an unfolded position, the shoulder mount prevents movement of the lever and the resultant movement of the latch to the unlocking position.

11. The connection mechanism according to claim 10, wherein:

the closing part contains a pin for rotary connection of the receiver of the firearm to the shoulder mount; the elastic spring is a compression spring; and the lever is rotatably mounted to the receiver by a lever pin, a top end of the lever being designed for manual control of the lever while a bottom end of the lever is connected to the latch, so that when the shoulder mount is removed or folded away, the latch can be selectively moved against the compression spring to the unlocking position by pushing the top end of lever in the shooting direction, and when the shoulder mount is in the unfolded position, a front face of the shoulder mount prevents the latch from being moved to the unlocking position, thereby preventing unwanted separation of the shoulder mount from the receiver.

* * * * *